US007469624B1

(12) United States Patent
Adams

(10) Patent No.: US 7,469,624 B1
(45) Date of Patent: Dec. 30, 2008

(54) DIRECT DRIVE RETROFIT FOR RIFLES

(76) Inventor: Jason Adams, 1511 Colony Ct., Palm Harbor, FL (US) 34683

( * ) Notice: Subject to any disclaimer, the term of this patent is extended or adjusted under 35 U.S.C. 154(b) by 0 days.

(21) Appl. No.: 11/938,678

(22) Filed: Nov. 12, 2007

(51) Int. Cl.
*F41A 5/00* (2006.01)

(52) U.S. Cl. ..... 89/191.01; 89/191.02; 89/192; 89/193

(58) Field of Classification Search ..... 89/191.01, 89/191.02, 192, 193
See application file for complete search history.

(56) References Cited

U.S. PATENT DOCUMENTS

| | | | |
|---|---|---|---|
| 3,246,567 | A | 4/1966 | Miller |
| 4,244,273 | A | 1/1981 | Langerndorfer, Jr. et al. |
| 4,765,224 | A | 8/1988 | Morris |
| 5,351,598 | A | 10/1994 | Schuetz |
| 6,634,274 | B1 | 10/2003 | Herring |
| 6,722,255 | B2 | 4/2004 | Herring |
| 2003/0126781 | A1 | 7/2003 | Herring |
| 2003/0136041 | A1 | 7/2003 | Herring |
| 2005/0011345 | A1 | 1/2005 | Herring |
| 2005/0081707 | A1 | 4/2005 | Herring |
| 2006/0065112 | A1 | 3/2006 | Kuczynco et al. |
| 2006/0283067 | A1 | 12/2006 | Herring |

*Primary Examiner*—Stephen M Johnson
*Assistant Examiner*—Daniel J Troy
(74) *Attorney, Agent, or Firm*—Aaron P. McGushion

(57) ABSTRACT

A direct drive retrofit system for use with an M-16 or AR-15 rifle for conversion from an impingement system comprising: a gas block, the gas block having a barrel bore and a gas plug bore; a gas plug, the gas plug being inserted into the gas plug bore from the muzzle end; a bolt carrier key, the bolt carrier key being configured to mount directly to a bolt carrier; a rod, the rod being manufactured from a single continuous material stock; and a biasing means; wherein, the rod can be uninstalled without removal of a hand guard or the gas block by extracting the gas plug from the gas plug bore from the muzzle end, the actuating means releasing the rod, the rod being freely extracted thereafter by a user in a single piece.

9 Claims, 4 Drawing Sheets

Gas Exhaust
Gas Inlet

DIRECT DRIVE RETROFIT FOR RIFLES

BACKGROUND OF THE INVENTION

1. Field of the Invention

This invention relates generally to an improvement to the impingement system of the M-16 and AR-15 rifle platforms, and more particularly to the replacement of the impingement system with a direct drive system.

2. Description of the Related Art

Replacing the impingement system of the M-16 or AR-15 is not a new idea. Many attempts have been made to do so. It is well known to those who use this rifle and those in industry that the M-16 is notorious for fouling and jamming due to the design requiring that the discharge gas be directed into the bolt carrier to activate the bolt and discharge the spent shell.

The disadvantages of the OEM impingement system are well known, primarily due to the hot, dirty gasses being directed into the bolt carrier and receiver. The heat alone tends to wear parts down, exposing this area to thermal cycling. With the addition of soot or carbon from the expelled gasses, the moving parts within the bolt carrier and receiver are exposed to a hostile environment. This is exacerbated by the constant need to lubricate this entire area; the oil serving to trap particles and carbon. This combination of factors cause the parts to break, wear, or operate improperly. The areas of failure can include the fouling and wear of the gas rings, loosening of the ejector and extractor springs causing the spent shell to not be ejected properly, the bolt carrier is prevented form traveling properly within the receiver, as the chamber becomes fouled and increases in temperature causing the entrapment of the spent shell, the melting of the gas tube causing a restriction of flow to the bolt carrier and subsequent failure. Basically, to ensure the proper operation of the rifle, it must be cleaned and continually lubricated. With many parts to keep track of, consistent cleaning is more difficult in the field.

Others have developed systems to replace the OEM impingement system. Some require that significant portions of the rifle be modified or replaced, such as the barrel and parts within the receiver. These systems have obvious drawbacks. The cost of replacing the barrel and other parts is substantial and unnecessary. If machining is required to install the system, the user must send the rifle to a machinist to be modified, added time and expense to the process, and potentially introducing error with each independent machining process.

Some manufacturers have designed systems that do not require the replacement of the barrel and are an improvement over the OEM and previous systems, such as the system manufactured by Land Warfare Resources Corporation (LWRC). The problems with these existing systems arise during assembly or disassembly for cleaning and inspection. These systems require that a substantial portion of the system be removed to access the rod assembly or the gas plug located in the gas block. Often, it is required that the hand guard be removed, the gas block loosed and slid muzzleward so that the gas plug is free to be removed and the rod assembly is accessible and also free. Existing systems must also segment the rod into several sections, so that the assembly can be removed from the tight quarters beneath the hand guard. A single piece or continuous rod is not possible in this system. A single rod would not have the necessary clearance to be removed in tact.

What is needed and not heretofore provided by the existing art is a direct drive retrofit system to replace the impingement system of the OEM rifle. What is further needed is a retrofit system that does not require machined modification or replacement of the barrel and other primary parts of the rifle. What is further needed is a retrofit system that is easily assembled and disassembled in the field, by minimizing complexity and the overall number of parts. What is again needed is a retrofit system that can be removed for inspection and cleaning without substantial disassembly of neighboring parts, such as the gas block or hand guard.

OBJECTS OF THE INVENTION

Accordingly, it is an object of the present invention to provide an improved device for the replacement of the OEM rifle impingement system with a direct drive retrofit system.

It is a further object of the present invention to provide a retrofit system that does not require machined modification or replacement of the barrel and other primary parts of the rifle.

It is a further object of the present invention to provide a retrofit system that is easily assembled and disassembled in the field, by minimizing complexity and the overall number of parts.

It is a further object of the present invention to provide a retrofit system where the gas plug and rod can be removed for inspection and cleaning without substantial disassembly of neighboring parts, such as the gas block or hand guard.

These and other objects and advantages of the present invention will become apparent upon reading the following detailed description and upon reference to the accompanying drawings.

SUMMARY OF THE INVENTION

The present invention provides a new and unique direct drive retrofit system for the M-16 rifle platform, eliminating the drawback of the original impingement system, such as fouling, jamming, and general unreliability in extreme condition. The present invention also provides a direct drive system that is unique to the existing M-16 modification systems and kits. The present invention provides a retrofit system that does not require modification to the existing core parts of the rifle, such as the stock, barrel, bolt carrier, and such. The present invention also provides a system that can be easily removed in the field, minimizing the number of individual parts to decrease loss, enabling the removal of the gas plug and connecting rod without the removal of the gas block or hand guard, and, because the rod is a single unit, the rod can be decoupled from the bolt carrier key from the front of the rifle near the gas block and, when installed, transmits energy from expelled gasses more effectively to the blot carrier, due to the minimize loss design of the rod. All of these benefits over the existing technologies and more will become evident in the further discussion of the invention as follows.

A direct drive retrofit system for use with an M-16 or AR-15 rifle for conversion from an impingement system is disclosed comprising: a gas block, the gas block having a barrel bore and a gas plug bore, both extending completely through the gas block, the barrel bore and the gas plug bore being substantially parallel one to the other, the barrel bore being configured to receive a barrel securely inserted therein, the barrel bore having an aperture being configured to receive a discharge gas from a gas port formed through the barrel proximate to a muzzle of the rifle, the aperture extending from the barrel bore to the gas plug bore, the aperture directing the discharge gas towards the gas plug bore, the gas block being secured to the barrel substantially preventing movement of the gas block relative to the barrel and being configured to hermetically transport the discharge gas from the barrel to the gas plug bore, the gas plug bore having a muzzle end opening towards the muzzle and a breech end opening towards a breech of the rifle; a gas plug; the gas plug being inserted into the gas plug bore from the muzzle end, the gas plug being secured within the gas plug bore by a securing means, an exhaust portion of the gas plug extending out of the breech end of the gas block, the gas plug having a passage being formed internally, the discharge gas being delivered hermetically from the aperture to the passage and towards the exhaust portion; a bolt carrier key, the bolt carrier key being configured to mount directly to a bolt carrier, the bolt carrier moving synchronously with the bolt carrier; a rod, the rod being configured as a single part or a securely connected assembly, the rod extending from the gas plug to the bolt carrier key, a first end of the rod being coupled to the gas plug, a second end being coupled to the bolt carrier key; an actuating means, the actuating means forming an actuation coupling between the gas plug and the rod, the actuating means imparting a kinetic energy of the high pressure the discharge gas on the rod, the actuating means permitting the rod to be actuated linearly in a breechward direction; a biasing means, the biasing means urging the rod towards the gas plug with an urging force, the biasing means permitting translational movement of the rod when the urging force is exceeded by the actuating means, wherein, upon the firing of a round, the discharge gas under pressure is diverted into the gas port of the barrel, the discharge gas then being transported to the aperture, the discharge gas thereafter being delivered into the passage of the gas plug; and wherein, the discharge gas provides a force to the actuating means, the actuating means causing the breechward motion of the rod translationally; and wherein, the rod thereafter actuates the bolt carrier key causing a breechward translation of the bolt carrier, the breechward translation activating the bolt carrier and an extractor; and wherein, the rod can be uninstalled without removal of a hand guard or the gas block by extracting the gas plug from the gas plug bore from the muzzle end, the actuating means releasing the rod, the rod being freely extracted through the gas plug bore thereafter by a user in a single piece.

As discussed in the background, one of the primary drawbacks of the existing direct drive systems for the M-16 platform is the inability to easily disassemble the system in the field, under extreme conditions. To accommodate this need for easy access for cleaning, repair, and inspection, the present invention has been designed with a unique combination of parts that make disassembly and assembly possible in a quick and easy manner.

The first feature that enables quick access is the gas block and gas plug design. As mentioned, in previous designs, the gas block must be unbolted or loosened from the barrel, to allow the gas block to slide muzzleward, thereby releasing the connection assembly (rods or other direct connectors to the blot carrier) and allowing the removal of the connection assembly. Because the gas block is difficult to align with the original discharge gas aperture in the barrel, removing the gas block is time consuming and difficult. The present invention's gas block and gas plug design allows the gas plug to be detached and slide forward, towards the muzzle, without affecting the position of the gas block or even loosening it. As the gas block is slid forward, in the preferred embodiment, it automatically releases a piston-cylinder coupling relationship between it and the rod, the gas plug clearing and completely separating from the gas block, leaving the rod to be pulled out around the gas block or through the gas plug bore that housed the gas plug.

Even the rod is designed for easy access. In some existing systems, the rod is segmented in a plurality of parts, so that they can be removed, these systems not being designed for the simple removal of the rod in one piece without disturbing the gas block. The disadvantages of segmenting the rod include the fact that there are more small parts to keep track of and potentially lose in the field, and the inherent inefficiencies of transmitting energy through a rod of several parts instead of the continuous rod of the present invention, each joint of the segmentation creating an opportunity for energy loss in the transmission of motion from the gas block to the bolt carrier. The rod of the present invention is a single piece design, preferable being machined from one single piece of material; although it is possible to take several pieces of material and bond them in a permanent or semi permanent with welding processes or fastening processes, so that the rod acts and remains intact as one part.

The rod and bolt carrier key coupling is also important for the easy removal of the rod without removal of the gas bock or hand guard. The biasing means is a compression coil spring, the rod being inserted into the compression coil spring, the coil spring being compressed between the bolt carrier key and an annular shelf formed on an outer circumference of the rod.

In the preferred embodiment, the breechward end of the rod is configured to rest within a cavity in the bolt carrier key. A coil spring or other biasing means urges the rod away from the bolt carrier key and towards the piston-cylinder coupling of the muzzleward end of the rod and the gas plug, the rod being trapped securely between the two couplings when installed. When the piston-cylinder coupling is detached, the rod is free to slide out of the cavity and be pulled from the assembly. Other couplings between the rod and bolt carrier key are possible, that permit the removal of the rod without direct access to the bolt carrier key. For example, in an alternate embodiment, the second end of the rod (the beechward end) is flat-faced, contacting a flat face on the bolt carrier key, so that the rod has the capability of pushing the bolt carrier key back abutment.

The direct drive retrofit system wherein the actuating means is a piston-cylinder coupling further comprising: a piston, the piston being formed by the exhaust portion of the gas plug, the exhaust portion being generally cylindrical in shape forming the piston; an exhaust outlet, the exhaust outlet being formed at a terminus of the exhaust portion, the exhaust outlet permitting the expelling of the discharge gas; a cylinder, the cylinder being formed by the first end of the rod, the first end being generally cylindrically hollow in shape forming the cylinder, the piston being configured to nest within a hollow portion of the cylinder, a piston outer diameter being smaller than a cylinder inner diameter, a gap being formed therebetween; wherein, upon the firing of the round, the discharge gas under pressure is expelled from the exhaust outlet, the discharge gas imparting the force into the cylinder, the cylinder resultantly translating breechward thus causing the breechward motion of the rod; and wherein the discharge gas is released to atmosphere through the gap.

The rod preferably has a cup shaped cylinder formed on the muzzleward end; the cylinder is configured to receive the end of the gas plug, the gas plug acting as a piston. The gas plug has a passage to allow the discharge gas to flow from the barrel breechward to the piston portion of the gas plug, exiting the exhaust outlet on the terminus of the piston. The exhaust gas impacts the cylinder, pushing the rod breechwards. After pushing the rod, the discharge gas exits the system through the gap formed between the inner diameter of the cylinder and outer diameter of the piston. It is possible, although not the best mode, to arrange the gas plug as a cylinder and the end of the rod as a piston, effectively reversing the arrangement from the preferred mode.

To enable the mounting of a scope or other equipment the gas block can be designed with a Picatinny rail formed thereon.

The direct drive retrofit system wherein the securing means further comprises: at least one key, the key being formed on an outer surface of the gas plug; a keyway, the keyway being formed within the gas plug bore, the keyway being configured to receive the key; a detent, the detent having a spring loaded ball, the detent being located on the gas plug, a depression being located in a corresponding position within the gas plug bore; wherein the key is aligned with the keyway, the gas plug is inserted into the gas plug bore, the spring loaded ball nesting within the depression.

Because the gas plug undergoes extreme stresses in the course of firing a round, it is important to firmly secure the gas block to the barrel and the gas plug to the barrel. The gas block is secured to the barrel in a pipe clamp type arrangement with two screws providing compression to clamp the block to the barrel.

It is possible to have one key or a plurality of keys formed on the gas block; preferably there are two opposing keys. There are, therefore, two corresponding keyways formed in the gas plug bore of the gas block. The keys prevent substantial rotation of the gas plug relative to the gas block, allowing for the consistent and accurate alignment of the internal passage of the gas plug to the gas port of the rifle barrel, either directly or through the gas block. The detent prevents substantial linear movement of the gas plug along its axis when secured into a corresponding hole or depression in the gas block. A hole formed through the gas plug bore to the external wall of the gas block would provide a stop for the detent and allow user access to the detent to depress it during the removal process. It is also possible to form a crook in the keyway to provide further axial security.

As mentioned, an extremely important aspect of the present invention is the ability to remove the gas plug and rod without removing the hand guard or moving the gas block forward. The unique combination of parts make this possible; and also require a unique method of assembly and disassembly. The initial installation of the system is more involved, requiring replacement of the OEM gas block, OEM hand guard, OEM bolt carrier key, OEM hand guard bracket, and removal of the gas line. Once the new gas block and bolt carrier key has been installed, it is often only required to remove just the rod and gas plug to access parts for cleaning and inspection. Higher levels of disassembly are possible by removing the new hand guard and new hand guard bracket; and the highest level of disassembly would require the removal of the gas block. However, under most field circumstances it is only necessary to remove the rod and gas plug.

A method for removing a direct drive retrofit system for an M-16 or AR-15 rifle consisting of a gas block, a gas plug, a rod, a piston-cylinder coupling, and a bolt carrier key without removal of a hand guard or the gas block comprising the steps: extracting the gas plug from the gas block in a muzzleward direction; decoupling the piston-cylinder coupling formed between the gas plug and the rod, a piston formed on the gas plug being slid out of a cylinder being formed on the rod upon extraction; removing the rod in a singular piece, the rod being free to be lifted away from the gas block, the rod being decoupled from the blot carrier key without requiring access to the bolt carrier key.

A method for installing a direct drive retrofit system for an M-16 or AR-15 rifle consisting of a gas block, a gas plug, a rod, a piston-cylinder coupling, and a bolt carrier key without removal of a hand guard or the gas block comprising the steps: inserting the rod in a singular piece through the hand guard, the rod being coupled to the blot carrier key without requiring access to the bolt carrier key; inserting the gas plug into a gas plug bore from the muzzleward direction towards the breech; coupling a cylinder being formed on the gas plug to a cylinder being formed on the rod, the piston being nested within the cylinder forming a piston-cylinder coupling; securing the gas plug within the gas plug bore.

DESCRIPTION OF THE PREFERRED EMBODIMENTS

Figure 1:
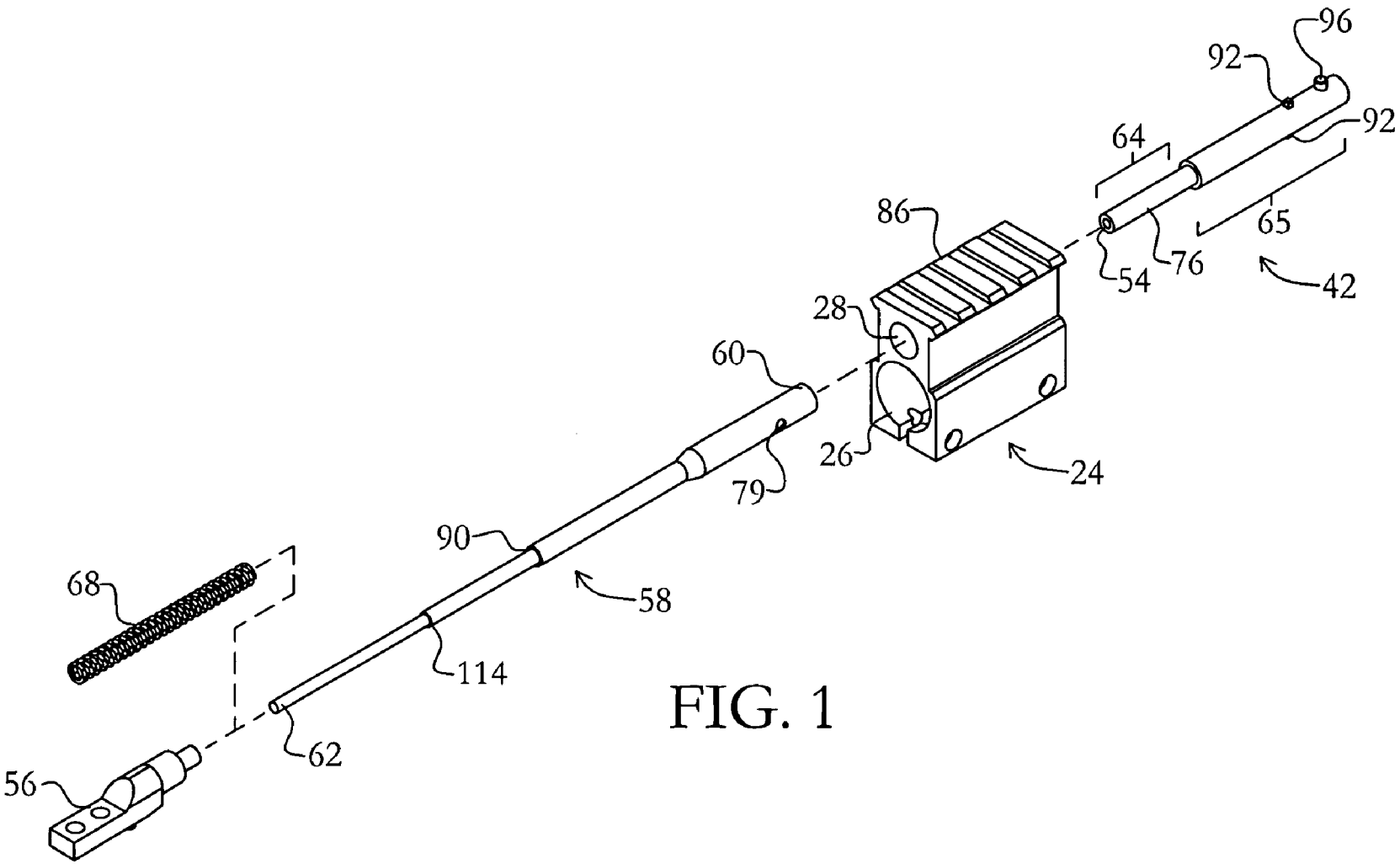
FIG. 1 is an illustration of the direct drive retrofit system (20) of the present invention in exploded perspective.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

An exemplary embodiment of the present invention is shown in FIGS. 1-6. Looking first at FIG. 1, the direct drive retrofit system (20) is shown in an exploded view, with dashed lines indicating the assembly configuration. The primary parts of the present invention comprise a gas plug (42), a gas block (24), a rod (58), a coil spring (68), and a bolt carrier key (56). Looking at the gas block (24), there are two bores formed through the body, the gas plug bore (28) and the barrel bore (26). The gas plug bore (28) is configured to receive the gas plug (42); and the barrel bore (26) is configured to receive a barrel (30) of a rifle (22). On the top portion of the gas block (24) a Picatinny rail (86) is formed for receiving mounted equipment, such as a scope (not shown). The rod (58) is configured to couple with the gas plug (42) at a first end (60) and the bolt carrier key (56) at a second end (62). The second end (62) of the rod (58) is inserted into the coil spring (68), one end of the coil spring resting on the annular shelf (90). Looking at the gas plug (42), there is an exhaust portion (64) with a passage (54) formed therethrough. There are two keys (92) and a depressible detent (96) formed on the main body (65) of the gas plug (42).

Figures 2, 3, 4:
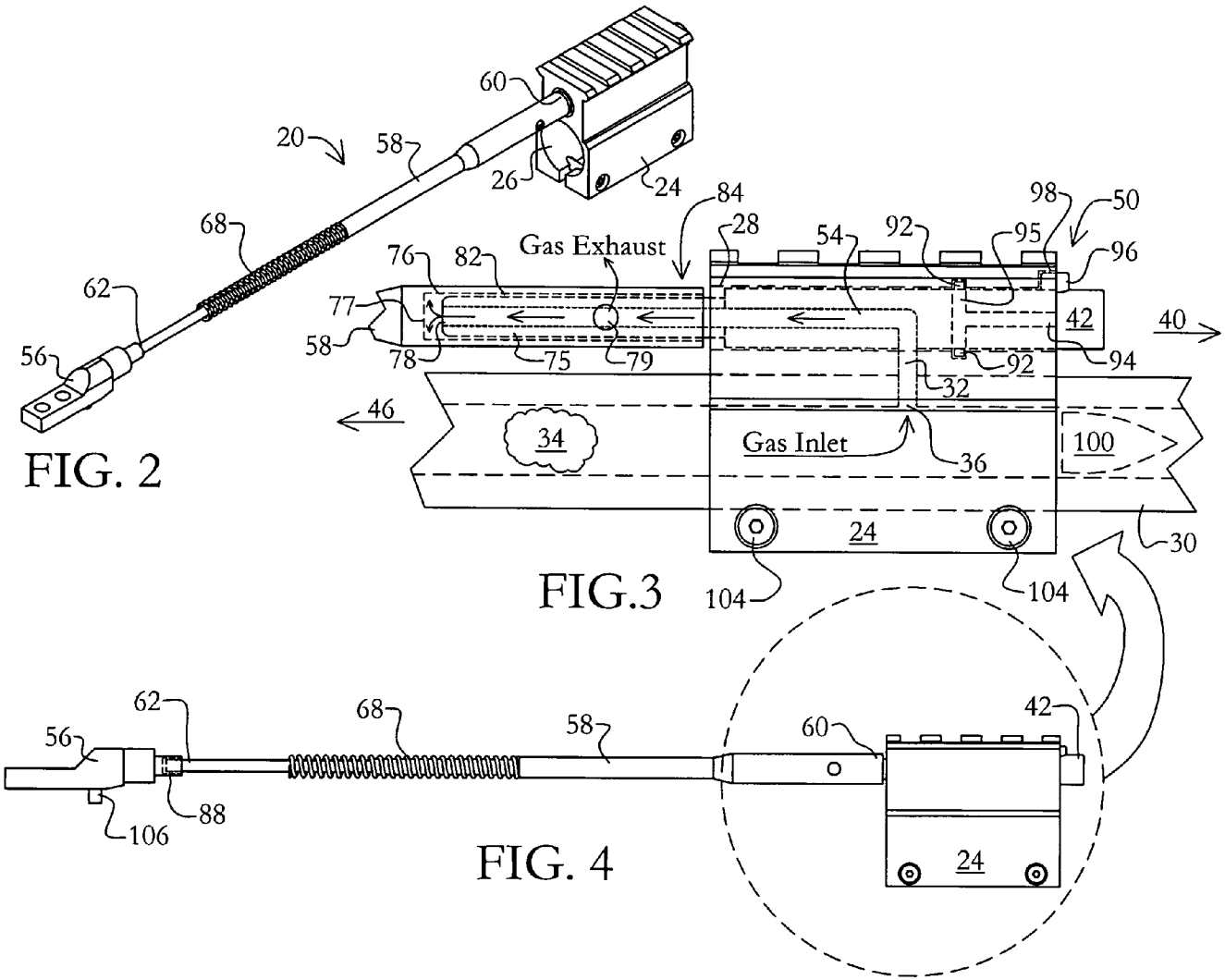
FIG. 2 is an illustration of the direct drive retrofit system (20) of the present invention in perspective.
FIG. 3 is a magnified illustration of the direct drive retrofit system (20) of the present invention with internal details shown in phantom.
FIG. 4 is an illustration of the direct drive retrofit system (20) of the present invention in profile.

Turning to FIGS. 2 and 4, the primary parts of the present invention are shown in an assembled state, without showing the rifle (22), to clearly show how these parts are connected in the assembled direct drive retrofit system (20). In FIG. 4, the second end (62) of the rod (58) is inserted into a cavity (88) formed in the bolt carrier key (56), in a slip fit relationship.

Looking at FIG. 3, a close-up view of the gas block (24), barrel (30), gas plug (42), and the first end (60) of the rod (58), showing the details of the piston-cylinder coupling (84) and how the discharge gas (34) actuates the coupling, also showing the details of the securing means (50) holding the gas plug (42) within the gas plug bore (28) of the gas block (24). The gas block (26) is securely fastened to the barrel (30) by tightening screws (104). Although, other fastening arrangements are possible, the screws (104) are preferred for effectiveness and simplicity.

Focusing first on the path of the discharge gas (34), a round (100) is fired in the rifle (22) traveling in the muzzleward direction (40) being propelled by the discharge gas (34). When the round (100) passes the gas port (36) formed through the barrel (30), a portion of the discharge gas (34) is directed therein. The discharge gas (34) fluidly communicates with the passage (54) in the gas plug (42) via the aperture (32) formed in the gas block (24), leading from the barrel bore (26) to the gas plug bore (28). The discharge gas (34) travels in the breechward direction (46) through the passage (54) from the main body (65) to the exhaust portion (64), exiting the gas plug (42) into the piston-cylinder coupling (84) formed between the rod (58) and the gas plug (42), a bore in the rod (58) forming the cylinder (76) and the exhaust portion (64) of the gas plug (42) forming the piston (75).

Upon exiting the passage (54), the discharge gas (34) impinges on the bottom (77) of the cylinder (76). The pressure of the discharge gas (34) exerts a force against the bottom (77) of the cylinder (76), pushing the rod (58) in the breechward direction (46). After imparting a breechward translation on the rod (58), the discharge gas (34) is directed through a gap (82) between the piston (75) and the cylinder (76), finally exiting to atmosphere through the exhaust outlet (79). Upon the depressurization of the piston-cylinder coupling (84), the spring (68) urges the rod (58) back in the muzzleward direction (40). The rod (58) is normally biased in the muzzleward direction (40) when no pressure is present in the piston-cylinder coupling (84). Upon the resetting of the piston-cylinder coupling (84), the direct drive retrofit system (20) is prepared to receive the discharge gas (34) of the following round (100).

Looking more particularly at the securing means (50), upon insertion of the gas plug (42) into the gas plug bore (28) both keys (92) are aligned with their respective linear keyways (94). The linear keyways (94) terminate at an annular keyway (95), being formed over the diameter of the gas plug bore (28). The gas plug (42) is pushed straight back in the breechward direction (46), following the linear keyways (94). One linear keyway (94) is sufficiently large to partially receive the detent (96) which is aligned with one of the keys (92). In one embodiment, linear keyways (94) are formed at the 0 degree and the 180 degree marks. The keyway (94) at the 180 degree mark is sufficiently sized to partially receive the detent (96) when the detent is depressed. The gas plug (42) is then rotated to the 90 degree mark, to the detent notch (98), the keys (92) simultaneously rotating within the annular keyway (95). Upon reaching the detent notch (98) the detent is released and partially resides within the detent notch (98). The detent (96) prevents rotation of the gas plug (42) while the keys (92) within the annular keyway (95) prevent the movement of the gas plug (42) in or out of the gas plug bore (28).

Figure 5:
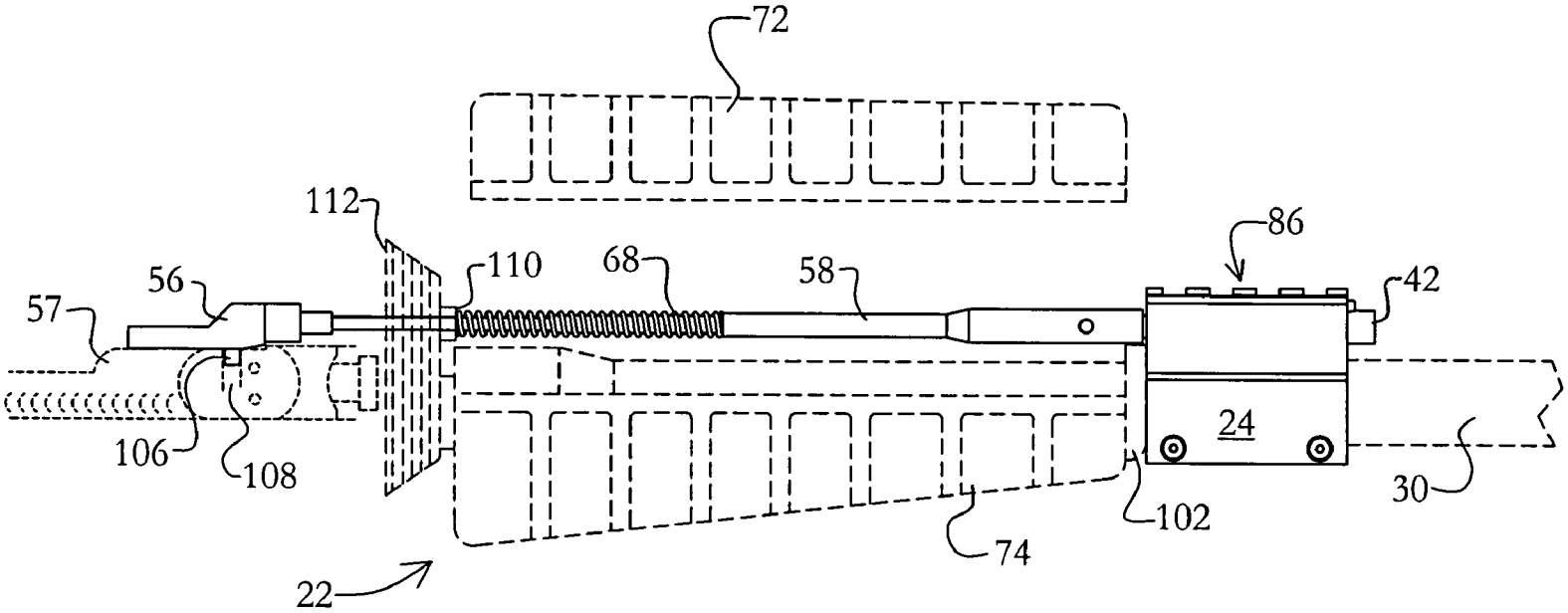
FIG. 5 is an illustration of the direct drive retrofit system (20) of the present invention in profile, installed on a rifle.

Looking now at FIG. 5, the direct drive retrofit system (20) is shown installed in an exemplary rifle (22), shown in phantom. The gas block (24) is fastened to the barrel (30), screws (104) tighten the barrel bore (26) around the barrel (30). The upper hand guard (72) and the hand guard bracket (102) are modified providing clearance to allow the rod (58) to freely translate. The lower hand guard (74) is fastened beneath the rifle (22). The coil spring (68) is partially compressed between the delta ring (112) and the annular shelf (90) of the rod (58). The second end (62) of the rod (58) nests within the cavity (88) of the bolt carrier key (56). The bolt carrier key (56) is mounted on the bolt carrier (57), the dowel protrusion (106) inserted into the OEM gas passage (108). Optionally, a busing (110) is shown, acting as a spacer to provide the correct spring force and also as a block to limit the breechward travel of the rod (58), the stop (114) of the rod (58) impacting the bushing (110), therefore stopping the travel. An added benefit of the bushing (110) and stop (114) is that it prevents the rod (58) from being dislodged from the gas plug (42) in the event of a spring (68) failure.

As the rod (58) translates in the breechward direction (46) the spring (68) is compressed and the bolt carrier key (56) is also translated in the breechward direction (46), pushing the bolt carrier (57) similarly back. The breechward translation of the bolt carrier (57) serves to extract the casing of the spent round, thereafter chambering the next live round, the process being repeated for the duration of the firing occurrence.

As stated previously, the most important advantage of this invention when compared to existing retrofit systems is the ability to easily disassemble and assemble the gas plug (42) and the rod (58) of the direct drive retrofit system (20) without the removal of the gas block (24), the upper hand guard (72), the lower hand guard (74), or the hand guard bracket (102). It is necessary, on occasion, to have the ability to easily access the parts of the rifle (22) that are exposed to the fouling discharge gas (34) for cleaning and service. The gas plug (42), the rod (58), and the gas plug bore (28) are all exposed to the discharge gas (34) to a degree, and therefore, require cleaning.

Figure 6:
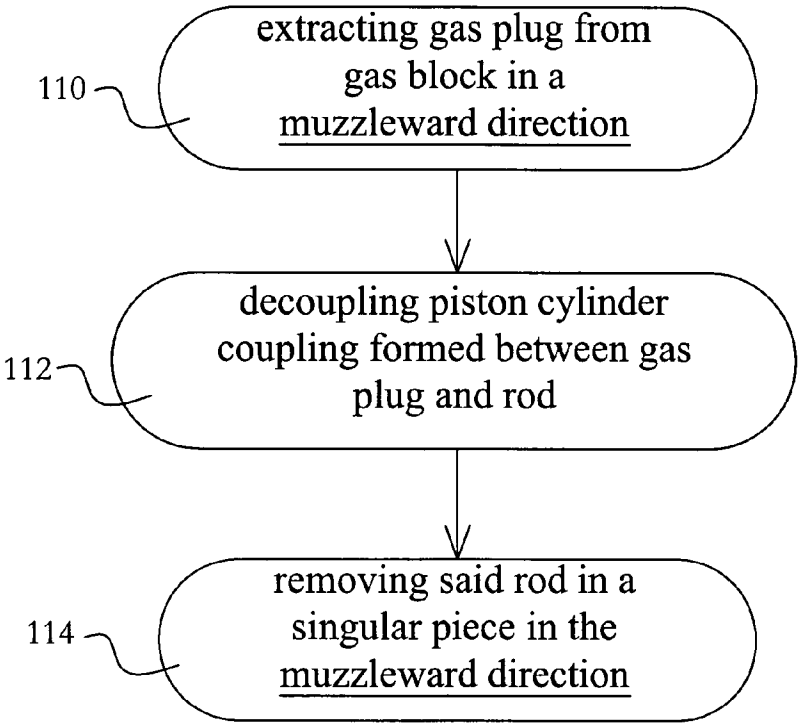
FIG. 6 is a diagram describing the disassembly of the direct drive retrofit system (20) of the present invention.

The method of disassembly is shown in the flowchart of FIG. 6. To start, the gas plug (42) is extracted from the gas block (24) in the muzzleward direction (40), (step 110). The piston-cylinder coupling (84) is decoupled (step 112), allowing the gas plug (42) to be fully removed from the gas plug bore (28). The rod (58) can then be removed as a single piece in the muzzleward direction (40), through the gas plug bore (28), (step 114).

While the present invention has been described with regards to particular embodiments, it is recognized that additional variations of the present invention may be devised without departing from the inventive concept.

Having thus described the invention, it is now claimed:

1. A direct drive retrofit system for use with an a rifle for conversion from an impingement system comprising:

a gas block, said gas block having a barrel bore and a gas plug bore, both extending completely through said gas block, said barrel bore and said gas plug bore being substantially parallel one to the other, said barrel bore being configured to receive a barrel securely inserted therein, said barrel bore having an aperture being configured to receive a discharge gas from a gas port formed through said barrel proximate to a muzzle of said rifle, said aperture extending from said barrel bore to said gas plug bore, said aperture directing said discharge gas towards said gas plug bore, said gas block being secured to said barrel substantially preventing movement of said gas block relative to said barrel and being configured to hermetically transport said discharge gas from said barrel to said gas plug bore, said gas plug bore having a muzzle end opening towards said muzzle and a breech end opening towards a breech of said rifle;

a gas plug; said gas plug being inserted into said gas plug bore entering from said muzzle end, said gas plug being secured within said gas plug bore by a securing means, an exhaust portion of the gas plug extending out of said breech end of said gas block, said gas plug having a passage being formed internally, said discharge gas being delivered hermetically from said aperture to said passage and towards said exhaust portion;

a bolt carrier key, said bolt carrier key being configured to mount directly to a bolt carrier, said bolt carrier key moving synchronously with said bolt carrier;

a rod, said rod being configured as a single part or a securely connected assembly, said rod extending from said gas plug to said bolt carrier key, a first end of said rod being coupled to said gas plug, a second end being coupled to said bolt carrier key;

an actuating means, said actuating means forming an actuation coupling between said gas plug and said rod, said actuating means imparting a kinetic energy of the high pressure said discharge gas on said rod, said actuating means permitting said rod to be actuated linearly in a breechward direction;

a biasing means, said biasing means urging said rod towards said gas plug with an urging force, said biasing means permitting translational movement of said rod when said urging force is exceeded by said actuating means, wherein, upon the firing of a round, said discharge gas under pressure is diverted into said gas port of said barrel, said discharge gas then being transported to said aperture, said discharge gas thereafter being delivered into said passage of said gas plug;

and wherein, said discharge gas provides a force to the actuating means, said actuating means causing said breechward motion of said rod translationally;

and wherein, said rod thereafter actuates said bolt carrier key causing a breechward translation of said bolt carrier, said breechward translation activating said bolt carrier and an extractor;

and wherein, said rod can be uninstalled without removal of a hand guard or said gas block by extracting said gas plug from the gas plug bore from said muzzle end, said actuating means releasing said rod, said rod being freely extracted through said gas plug bore thereafter by a user in a single piece.

2. The direct drive retrofit system of claim 1 wherein said actuating means is a piston-cylinder coupling comprising:

a piston, said piston being formed by said exhaust portion of said gas plug, said exhaust portion being generally cylindrical in shape forming said piston;

an exhaust outlet, said exhaust outlet being formed at a terminus of said exhaust portion, said exhaust outlet permitting the expelling of said discharge gas;

a cylinder, said cylinder being formed by said first end of said rod, said first end being generally cylindrically hollow in shape forming said cylinder, said piston being configured to nest within a hollow portion of said cylinder, a piston outer diameter being smaller than a cylinder inner diameter, a gap being formed therebetween;

wherein, upon the firing of said round, said discharge gas under pressure is expelled from said exhaust outlet, said discharge gas imparting said force into said cylinder by impingement of said gas on said cylinder, said cylinder resultantly translating breechward thus causing said breechward motion of said rod;

and wherein said discharge gas is released to atmosphere through and exhaust port via said gap.

3. The direct drive retrofit system of claim 2 wherein said cylinder is machined or formed directly in said rod.

4. The direct drive retrofit system of claim 1 wherein said biasing means is a compression coil spring, said rod being inserted into said compression coil spring, said coil spring being compressed between a delta ring and an annular shelf formed on an outer circumference of said rod.

5. The direct drive retrofit system of claim 1 wherein said first end of said rod is inserted into a cavity formed in said bolt carrier key.

6. The direct drive retrofit system of claim 1 wherein said direct drive retrofit system can be installed on said rifle without modification of said barrel and said bolt carrier.

7. The direct drive retrofit system of claim 1 wherein said gas block has a Picatinny rail formed thereon.

8. The direct drive retrofit system of claim 1 wherein said bolt carrier key has a dowel protrusion machined thereon, said dowel protrusion being configured to seat within an existing hole formed on said bolt carrier.

9. The direct drive retrofit system of claim 1 wherein said securing means comprises:

at least one key, said key being formed on an outer surface of said gas plug;

a keyway, said keyway being formed within said gas plug bore, said keyway being configured to receive said key;

a detent, said detent being spring loaded, said detent being located on said gas plug, a detent notch being located in a corresponding position within said gas plug bore;

wherein said key is aligned with said keyway, said gas plug is inserted into said gas plug bore, said spring loaded ball nesting at least partially within said detent notch.

* * * * *